US006674252B1

(12) United States Patent
Hsien

(10) Patent No.: US 6,674,252 B1
(45) Date of Patent: Jan. 6, 2004

(54) NON-BLINKING DIRECT CURRENT FLUORESCENT LAMP CIRCUIT

(76) Inventor: Wen-Fu Hsien, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/350,380

(22) Filed: Jan. 21, 2003

(51) Int. Cl.[7] ..... G05F 1/00

(52) U.S. Cl. ..... 315/291; 315/219; 315/224; 315/209 R; 315/287; 315/DIG. 5

(58) Field of Search ..... 315/177, 219, 315/254, 209 R, 224, 244, 247, 276, 278, 291, 307, 287, 200 R, DIG. 4, DIG. 5, DIG. 7

(56) References Cited

U.S. PATENT DOCUMENTS 4,277,728 A * 7/1981 Stevens ..... 315/307
4,859,914 A * 8/1989 Summa ..... 315/354
5,747,942 A * 5/1998 Ranganath ..... 315/224

* cited by examiner

*Primary Examiner*—Haissa Philogene

(57) ABSTRACT

A non-blinking direct current fluorescent lamp circuit includes a switch, a bridge rectifier, a voltage regulation circuit, a filter capacitor, an ignition circuit, a contact points converter, a ballasting circuit, and a pole exchange circuit. The switch is a common switch or a contact switch circuit. Thus, the non-blinking direct current fluorescent lamp circuit does not produce electromagnetic radiation, has a steady illuminance, can be started at one time, has a higher working efficiency, can save the energy, can be worked safely, has a higher reliability, and has a longer lifetime.

9 Claims, 4 Drawing Sheets

NON-BLINKING DIRECT CURRENT FLUORESCENT LAMP CIRCUIT

BACKGROUND OF THE INVENTION

1. Field of the Invention

The present invention relates to a non-blinking direct current fluorescent lamp circuit, and more particularly to a non-blinking direct current fluorescent lamp circuit without producing electromagnetic radiation, having a steady illuminance, having a softer light beam, having a higher working efficiency, saving the energy, having a higher reliability, and having a longer lifetime.

2. Description of the Related Art

The alternating current fluorescent lamps in accordance with the prior art generally include inductive ballast fluorescent lamps and an electronic ballast fluorescent lamps.

The conventional inductive ballast fluorescent lamp usually produces the flickers, thereby providing a worse illumination effect to the user, so that the user easily feels uncomfortable. In addition, the conventional inductive ballast fluorescent lamp cannot eliminate the waveform factor and cannot be worked at the optimum state constantly, thereby decreasing the light emitting efficiency.

The conventional electronic ballast fluorescent lamp usually produces the flickers, thereby providing a worse illumination effect to the user, so that the user easily feels uncomfortable. In addition, the conventional electronic ballast fluorescent lamp usually has a high frequency oscillation, thereby easily producing electromagnetic radiation, thereby causing danger to the user. Further, the conventional electronic ballast fluorescent lamp have the optimum matching problem, thereby decreasing the lifetime of the fluorescent tube.

SUMMARY OF THE INVENTION

The present invention is to mitigate and/or obviate the disadvantage of the conventional alternating current fluorescent lamp.

The primary objective of the present invention is to provide a direct current fluorescent lamp circuit without the flickers.

Another objective of the present invention is to provide a non-blinking direct current fluorescent lamp circuit without producing electromagnetic radiation.

A further objective of the present invention is to provide a non-blinking direct current fluorescent lamp circuit without incurring the ion drift effect.

A further objective of the present invention is to provide a non-blinking direct current fluorescent lamp circuit having a steady illuminance.

A further objective of the present invention is to provide a non-blinking direct current fluorescent lamp circuit having a softer light beam.

A further objective of the present invention is to provide a non-blinking direct current fluorescent lamp circuit that can be started at one time.

A further objective of the present invention is to provide a non-blinking direct current fluorescent lamp circuit having a higher working efficiency.

A further objective of the present invention is to provide a non-blinking direct current fluorescent lamp circuit that can save the energy.

A further objective of the present invention is to provide a non-blinking direct current fluorescent lamp circuit that can be worked safely.

A further objective of the present invention is to provide a non-blinking direct current fluorescent lamp circuit having a higher reliability.

A further objective of the present invention is to provide a non-blinking direct current fluorescent lamp circuit having a longer lifetime.

In accordance with the present invention, there is provided a non-blinking direct current fluorescent lamp circuit, comprising a switch, a bridge rectifier, a voltage regulation circuit, a filter capacitor, an ignition circuit, a contact points converter (relay), a ballasting circuit, and a pole exchange circuit, wherein:

the voltage regulation circuit includes at least one transistor, at least one diode, at least one zener diode, and at least one capacitor;

the ignition circuit includes at least one transistor, at least one impulse transformer, at least one diode, and at least one capacitor;

the ballasting circuit includes at least one transistor, and at least one diode; and the pole exchange circuit includes at least one integrated circuit, at least one transistor, at least one relay, at least one diode, at least one zener diode, and at least one capacitor.

Further benefits and advantages of the present invention will become apparent after a careful reading of the detailed description with appropriate reference to the accompanying drawings.

DETAILED DESCRIPTION OF THE INVENTION

Figure 1:
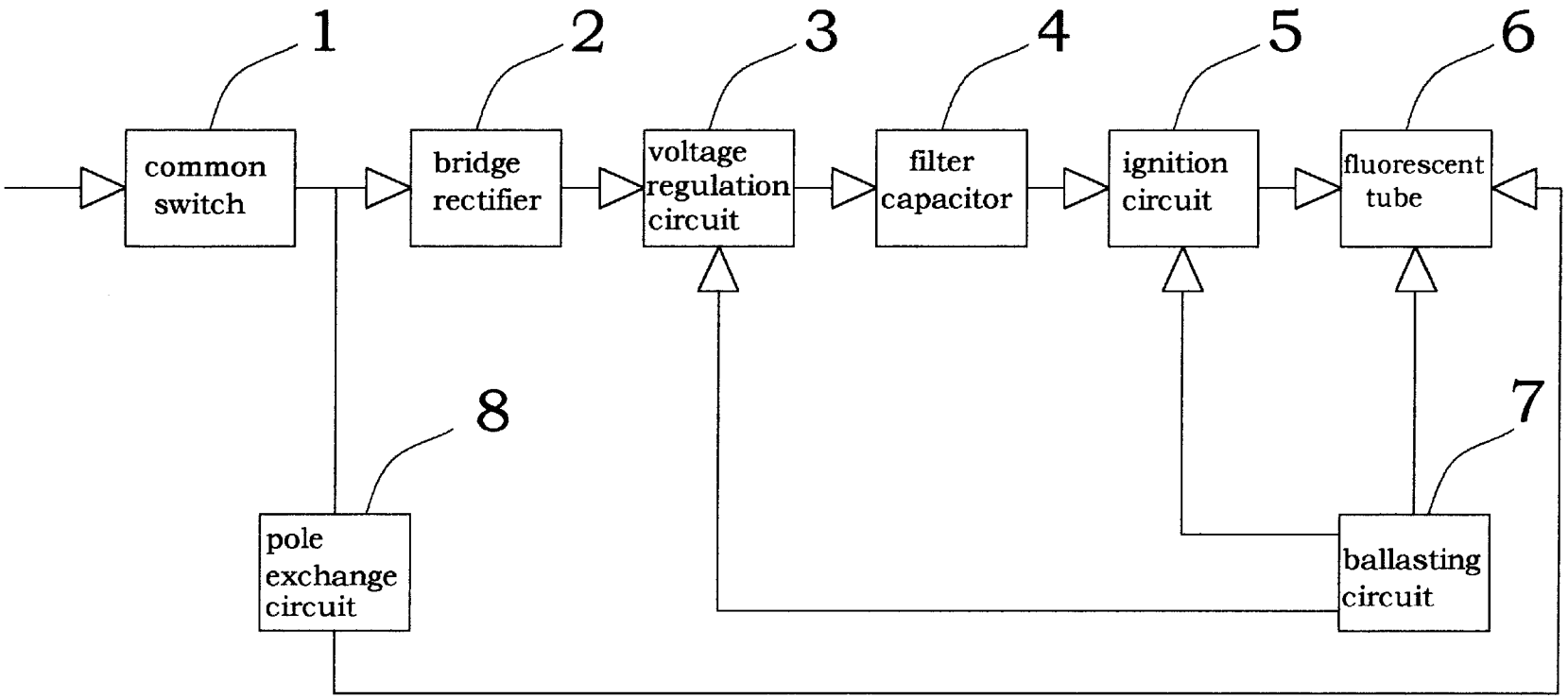
FIG. 1 is a block diagram of a non-blinking direct current fluorescent lamp circuit in accordance with a first embodiment of the present invention.
Figure 2:
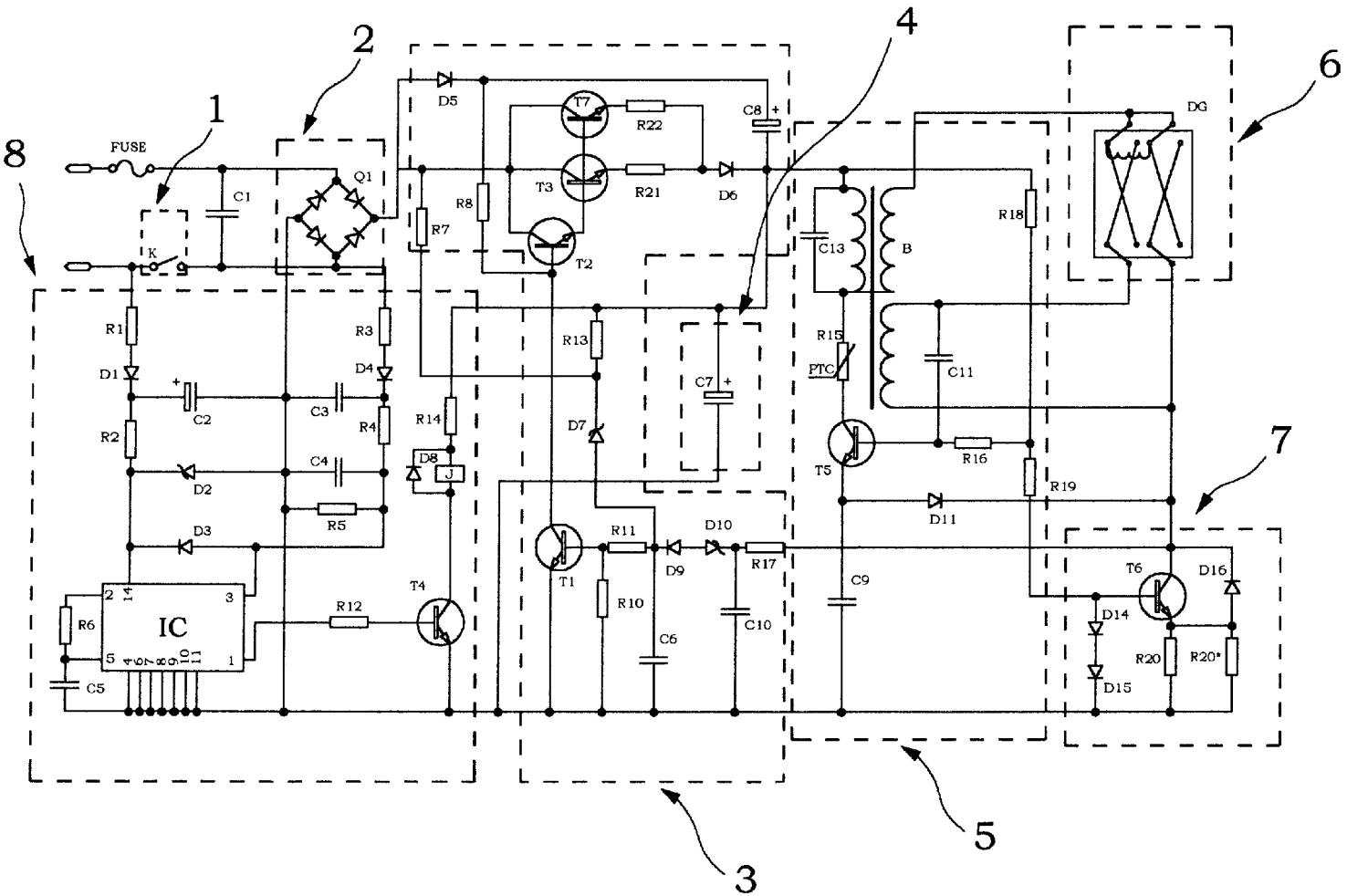
FIG. 2 is a circuit diagram of the non-blinking direct current fluorescent lamp circuit in accordance with the first embodiment of the present invention.
Figure 3:
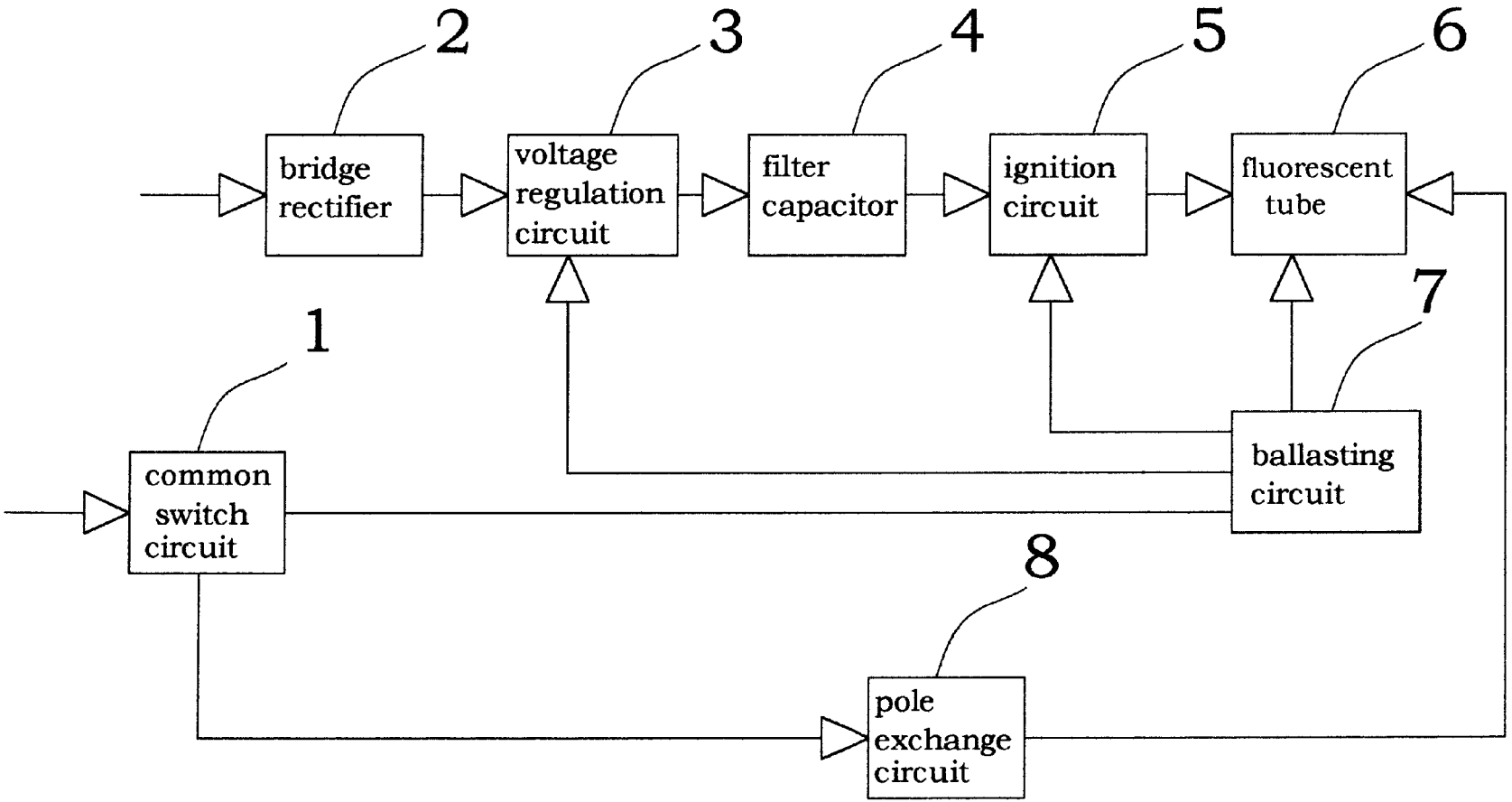
FIG. 3 is a block diagram of a non-blinking direct current fluorescent lamp circuit in accordance with a second embodiment of the present invention.
Figure 4:
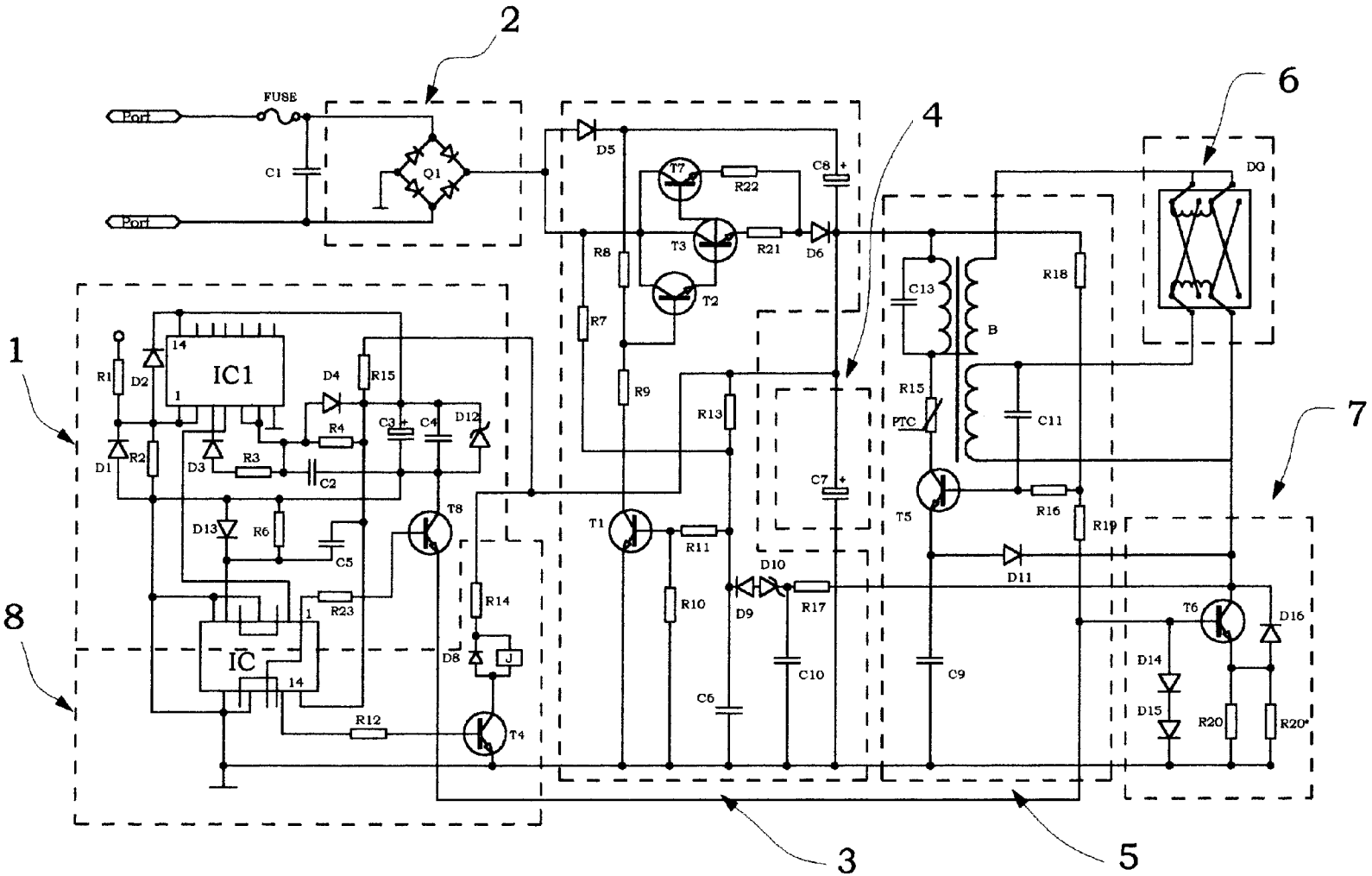
FIG. 4 is a circuit diagram of the non-blinking direct current fluorescent lamp circuit in accordance with the second embodiment of the present invention.

In general, the non-blinking direct current fluorescent lamp circuit in accordance with the present invention includes a common switch type circuit as shown in FIGS. 1 and 2, and a contact switch type circuit as shown in FIGS. 3 and 4.

Referring to the drawings and initially to FIGS. 1 and 2, the common switch type non-blinking direct current fluorescent lamp circuit in accordance with the first embodiment of the present invention comprises a common switch 1, a bridge rectifier 2, a voltage regulation circuit 3, a filter capacitor 4, an ignition circuit 5, a fluorescent tube and convertive contact points in relay 6, a ballasting circuit 7, and a pole exchange circuit 8.

The block 1 is a common switch K.

The block 2 is a bridge rectifier Q1.

The voltage regulation circuit 3 includes four transistors T1, T2, T3 and T7, three diodes D5, D6 and D9, two zener diodes D7 and D10, and three capacitors C6, C8 and C10.

The block 4 is a filter capacitor C7.

The ignition circuit 5 includes a transistor T5, an impulse transformer B, a diode D11, and three capacitors C9, C11 and C13.

The block 6 represents the convertive contact points of the relay J and the fluorescent tube DG.

The ballasting circuit 7 includes a transistor T6, and three diodes D1 4, D15 and D16.

The pole exchange circuit 8 includes an integrated circuit IC, a transistor T4, a relay J, four diodes D1, D3, D4 and D8, a zener diode D2, and four capacitors C2, C3, C4 and CS.

The principle and connection of the primary components are described as follows.

The voltage regulation circuit 3 is especially designed for the direct current fluorescent lamp. The voltage of the alternating current power varies between 100 V–120 V. The voltage of the fluorescent tube also has determined variation, e.g., 85 V–95 V. However, the direct current voltage after being rectified and filtered must be greater than the voltage of the direct current fluorescent tube with 10 V. Namely, the direct current voltage after being rectified and filtered is about 95 V–105 V, so that the direct current fluorescent lamp can work normally. That is, the ballasting circuit 7 has to keep at the voltage of 10 V so as to work normally, which is accomplished by the voltage regulation circuit 3. The working principle of the voltage regulation circuit 3 is described as follows.

The two transistors T2 and T3 are combined to form a darlington circuit, so that the amplifying times of the total current is greater than 1000. If necessary, the transistors T2, T3 and T7 are combined to provide a larger power. The voltage on the positive electrode of the capacitor C8 passes through the resistor R8 to provide a bias for T2, so that the darlington circuit is conducted and saturated. The current rectified by the bridge rectifier 2 passes through the darlington circuit, the resistor R21 and the diode D6, so as to charge the filter capacitor C7. When the voltage of the filter capacitor C7 is greater than 130 V (the up resistance of the zener diode D7), the current will pass through the resistor R13, the zener diode D7 and the resistor R11, so as to conduct the transistor T1, thereby cutting off the darlington circuit. Thus, the direct current voltage of the filter capacitor C7 will not be greater than that the steady-state value 130 V of the zener diode D7.

When the fluorescent tube DG is lighted, the voltage on the collector of the transistor T6 passes through the resistor R17, the zener diode D10 (7 V), the diode D9 and the resistor R11, and feed back to the base of the transistor T1, thereby reducing the charge current supplied to the filter capacitor C7, so as to regulate the direct current voltage of the filter capacitor C7, so that the direct current voltage on the collector of the transistor T6 is kept at about 10 V. Furthermore, the voltage regulation circuit has a greater efficiency and without producing electromagnetic radiation.

The ignition circuit 5 is also especially designed for the direct current fluorescent lamp. The working principle of the ignition circuit is in that the transistor T5, the impulse transformer B, the heat sensitive resistor R15, the diode D11, the three capacitors C9, C11 and C13, and the resistor R16 form an oscillator. The low tension coil of the impulse transformer B is connected to an end of the fluorescent tube, so as to preheat the filament and acts as a cathode. The high tension coil of the impulse transformer B has a first end connected to the other end of the fluorescent tube and acts as an anode, and a second end is connected to the positive electrode of the filter capacitor C7.

At the initial oscillation period of the oscillator, the resistance of the filament in the fluorescent tube is very low, so that the voltage on the low tension coil of the impulse transformer B is reduced, and the voltage on the high tension coil of the impulse transformer B is also kept in low value. When the filament of the fluorescent tube is heated, the resistance of the filament in the fluorescent tube is increased with many times, so that the voltage on the high tension coil of the impulse transformer B is increased correspondingly until the fluorescent tube is lighted.

At this time, the current produced on the positive electrode of the filter capacitor C7 passes through the high tension coil of the impulse transformer B, the anodic filament of the fluorescent tube DG, the mercury ion in the fluorescent tube, the cathodic filament of the fluorescent tube and through the transistor T6 and the two resistors R20 and R20* of the ballasting circuit, and is finally returned to the negative electrode of the filter capacitor C7. The magnitude of this current is controlled by the ballasting circuit. When the fluorescent tube is lighted, the voltage (10 V) on the collector of the transistor T6 will interrupt the current of the transistor T5 (the bias of the transistor T5 is about 3 V) on the oscillator, so that the oscillation stops.

The ballasting circuit 7 is also especially designed for the direct current fluorescent lamp. The ballasting circuit is used to control the current of the fluorescent tube. The two resistors R18 and R19 and the two diodes D14 and D15 produce a steady voltage (about 1.2 V) to be supplied to the base of the transistor T6. Thus, the magnitude of the current passing through the transistor T6 is determined by the resistance of the two shunted resistors R20 and R20*. In such a manner, the current and power of the fluorescent tube can be adjusted by changing the resistance of the two shunted resistors R20 and R20*.

The pole exchange circuit 8 is also especially designed for the direct current fluorescent lamp. Every time when the pole exchange circuit is operated, the anode and the cathode of the fluorescent tube are exchanged, thereby preventing the fluorescent tube producing the ion drift effect under the direct current working state after a long period of time.

For keeping the memory of pole exchange, the electric power of the pole exchange circuit is not interrupted by the switch. Thus, the alternating electric power before the switch K is connected to the resistor R1, the diode D1, the resistor R2, the capacitor C2, and the zener diode D2 (10 V) of those formed a steady power source (10 voltages) for the $14^{th}$ leg of IC. The resistor R3, the diode D4, the capacitor C3, the resistor R4, the capacitor C4, the resistor R5 and the diode D3 are combined to generate a signal passing through the leg 3 of the trigger IC. Every time when the switch K is turned on or turned off, a signal is sent to the trigger IC and output an alternating signal from the leg 1 of the trigger IC which passes through the resistor R12 to the base of the transistor T4, thereby conducting or interrupting the current of transistor T4, so that the relay J is operated to exchange the pole of the fluorescent tube.

Referring to FIGS. 3 and 4, the contact switch type non-blinking direct current fluorescent lamp circuit in accordance with the second embodiment of the present invention comprises a contact switch circuit 1, a bridge rectifier 2, a voltage regulation circuit 3, a filter capacitor 4, an ignition circuit 5, a fluorescent tube and convertive contact points in relay 6, a ballasting circuit 7, and a pole exchange circuit 8.

The contact switch circuit 1 includes one half of an integrated circuit IC1 (4093), five diodes D1, D2, D3, D4 and D13, a zener diode D12, four capacitors C2, C3, C4 and C5, one half of a bi-D trigger IC (4013), and a transistor T8.

The block 2 is also a bridge rectifier Q1.

The voltage regulation circuit 3 also includes four transistors T1, T2, T3 and T7, three diodes D5, D6 and D9, two zener diodes D7 and D10, and three capacitors C6, C8 and C10.

The block 4 is also a filter capacitor C7.

The ignition circuit 5 also includes a transistor T5, an impulse transformer B, a diode D11, and three capacitors C9, C11 and C13.

The block 6 also represents the convertive contact points of the relay J and the fluorescent tube DG.

The ballasting circuit 7 also includes a transistor T6, and three diodes D14, D15 and D16.

The pole exchange circuit 8 includes the other half of the bi-D trigger IC (4013), a transistor T4, a relay J, and a diode D8.

In practice, The resistor R5, the zener diode D12 and the two capacitors C3 and C4 form a steady voltage (12 V) for supplying the electric power to the integrated circuit IC1 and IC.

The principle of the contact switch circuit is described as follows.

The detected alternating current voltage (conducted by the human body) enters the contact switch circuit 1 from the contact point, then passes through the high value resistor R1, and is then rectified by the diode D1 into a positive voltage which is then input into the integrated circuit IC1 through the leg 1 and the leg 2, then rectified by a Schmitt trigger, then output from the integrated circuit IC 1 through the leg 4, and is connected to the leg 3 of bi-D trigger IC. Each time when the D trigger is triggered, the D trigger will convert its state, and the signal is output from the leg 1, then passed through the resistor R23 to the base of the transistor T8.

When the output terminal (the leg 1) of the D trigger IC is at a high electric voltage, the transistor T8 is conducted and saturated, thereby interrupting the current of transistor T6, so that the fluorescent tube is extinguished. When the switch is contacted again, the signal turns the output terminal (the leg 1) of D trigger IC into a low voltage, thereby interrupting the current of transistor T8, so that the ballasting circuit is disposed at the normal working state, the fluorescent tube is lighted again.

The function and principle of the pole exchange circuit 8 are substantially similar to that as described in the above-mentioned illustration, and the difference is described as follows.

The trigger signal of the contact switch is not obtained from the alternating current power, and is obtained from the output terminal (the leg 1) of the bi-D trigger IC. The trigger signal is added to the leg 11 (the CP terminal of the other D trigger), then being bisected, then output from the leg 13, then passed through the resistor R12 to the base of the transistor T4, thereby controlling the relay J so as to exchange the pole of the fluorescent tube. Thus, after the contact switch is contacted two times, the pole is exchanged one time.

Accordingly, the non-blinking direct current fluorescent lamp circuit in accordance with the present invention has the following advantages.

1. The current passing through the direct current fluorescent tube is a constantly steady current without incurring the flickers, thereby protecting the user's eyes.
2. The current passing through the direct current fluorescent lamp is a constantly steady current without incurring the electromagnetic radiation, thereby protecting the user's safety.
3. The direct current fluorescent lamp eliminates the waveform factor, and can be worked at the optimum state constantly, thereby providing a better light emitting efficiency.
4. The direct current fluorescent lamp has a steady-state circuit, so that the current passing the fluorescent tube is disposed at a steady state, thereby providing a better illumination effect to the user.
5. The current passing the fluorescent tube is disposed at a steady state, so that the fluorescent tube is worked at the optimum state constantly, thereby enhancing the working efficiency and increasing the lifetime of the fluorescent tube.
6. The direct current fluorescent tube is kept at the lower temperature, thereby increasing the lifetime of the fluorescent tube, and saving the manual work of maintenance.
7. The direct current fluorescent tube does not have the optimum matching problem, thereby increasing the lifetime of the fluorescent tube.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A non-blinking direct current fluorescent lamp circuit, comprising a switch, a bridge rectifier, a voltage regulation circuit, a filter capacitor, an ignition circuit, a contact points converter, a ballasting circuit, and a pole exchange circuit, wherein:

the voltage regulation circuit includes at least one transistor, at least one diode, at least one zener diode, and at least one capacitor;

the ignition circuit includes at least one transistor, at least one impulse transformer, at least one diode, and at least one capacitor, the ballasting circuit includes at least one transistor, and at least one diode; and the pole exchange circuit includes at least one integrated circuit, at least one transistor, at least one relay, at least one diode, at least one zener diode, and at least one capacitor.

2. The non-blinking direct current fluorescent lamp circuit in accordance with claim 1, wherein the contact points converter is the convertive contact points in a relay.

3. The non-blinking direct current fluorescent lamp circuit in accordance with claim 1, wherein the voltage regulation circuit includes four transistors, three diodes, two zener diodes, and three capacitors.

4. The non-blinking direct current fluorescent lamp circuit in accordance with claim 1, wherein the ignition circuit includes a transistor, an impulse transformer, a diode, and three capacitors.

5. The non-blinking direct current fluorescent lamp circuit in accordance with claim 1, wherein the ballasting circuit includes a transistor, and three diodes.

6. The non-blinking direct current fluorescent lamp circuit in accordance with claim 1, wherein the pole exchange circuit includes an integrated circuit, a transistor, a relay, four diodes, a zener diode, and four capacitors.

7. The non-blinking direct current fluorescent lamp circuit in accordance with claim 1, wherein the switch is a common switch.

8. The non-blinking direct current fluorescent lamp circuit in accordance with claim 1, wherein the switch is a contact switch circuit including at least one integrated circuit, at least one diode, at least one zener diode, at least one capacitor, and at least one transistor.

9. The non-blinking direct current fluorescent lamp circuit in accordance with claim 8, wherein the contact switch circuit includes a first integrated circuit, five diodes, a zener diode, four capacitors, a second integrated circuit, and a transistor.

* * * * *